US009183768B2

(12) United States Patent
Maguire et al.

(10) Patent No.: US 9,183,768 B2
(45) Date of Patent: Nov. 10, 2015

(54) SUPPORT SYSTEMS

(76) Inventors: Patrick David Maguire, Dunedin (NZ); Jason Paul Rogers, Pukekohn (NZ)

( * ) Notice: Subject to any disclaimer, the term of this patent is extended or adjusted under 35 U.S.C. 154(b) by 0 days.

(21) Appl. No.: 13/497,414

(22) PCT Filed: Sep. 21, 2010

(86) PCT No.: PCT/NZ2010/000188

§ 371 (c)(1),
(2), (4) Date: Mar. 21, 2012

(87) PCT Pub. No.: WO2011/034450

PCT Pub. Date: Mar. 24, 2011

(65) Prior Publication Data

US 2012/0312948 A1 Dec. 13, 2012

(30) Foreign Application Priority Data

Sep. 21, 2009 (NZ) ..... 579814
Oct. 7, 2009 (NZ) ..... 580233

(51) Int. Cl.
*G09F 17/00* (2006.01)
*G09F 15/00* (2006.01)
*G09F 7/22* (2006.01)

(52) U.S. Cl.
CPC ..... *G09F 15/0062* (2013.01); *G09F 7/22* (2013.01); *G09F 15/0068* (2013.01)

(58) Field of Classification Search
CPC ..... G09F 1/12; G09F 1/00; G09F 7/18; G09F 7/20; G09F 7/22; G09F 15/0025; G09F 15/0068
USPC ..... 248/309.1, 127, 146, 150, 152, 153, 248/158, 165, 166, 176.1; 40/152.1, 603, 40/155, 606.014
See application file for complete search history.

(56) References Cited

U.S. PATENT DOCUMENTS 4,592,158 A * 6/1986 Seely ..... 40/603
5,090,143 A * 2/1992 Schier et al. ..... 40/790
5,839,705 A 11/1998 LaMotte (Continued)

FOREIGN PATENT DOCUMENTS

DE 4018015 12/1991
GB 2334927 9/1999

(Continued)

OTHER PUBLICATIONS

Extreme Banner Display—You Tube http://www.youtube.com/watch?v=2Gqe0ygjFSs&feature=player_embedded, Jun. 5, 2008.

(Continued)

*Primary Examiner* — Todd M Epps
(74) *Attorney, Agent, or Firm* — Greer, Burns & Crain, Ltd.

(57) ABSTRACT

A support locator includes at least one body portion and at least one support portion, wherein the support portion is configured for engaging and retaining at least one strut member which holds a banner taught, and wherein the body portion is releasably connectable to a corner forming portion of a sheet of material forming the banner on the non-printed side of the banner, wherein the support portion projects substantially orthogonally out from a substantially planar body portion and wherein the plane of the body portion is parallel to that of the sheet material.

5 Claims, 9 Drawing Sheets

(56) References Cited

U.S. PATENT DOCUMENTS

| | | | | |
|---|---|---|---|---|
| 6,234,433 | B1 | 5/2001 | Maglione | |
| 6,385,884 | B1 * | 5/2002 | Valiulis | 40/642.01 |
| 6,454,227 | B1 | 9/2002 | LaMotte | |
| 6,493,973 | B1 * | 12/2002 | Nelson | 40/607.12 |
| 7,185,861 | B2 * | 3/2007 | LaMotte | 248/165 |
| 7,191,555 | B2 | 3/2007 | Hughes | |
| 2001/0015399 | A1 | 8/2001 | LaMotte | |
| 2004/0020156 | A1 * | 2/2004 | Kreller | 52/655.1 |
| 2005/0017137 | A1 | 1/2005 | Burris | |
| 2007/0006438 | A1 | 1/2007 | Loiola | |
| 2007/0057126 | A1 * | 3/2007 | Crookham et al. | 248/122.1 |
| 2008/0005945 | A1 | 1/2008 | Fritsche | |
| 2008/0040961 | A1 | 2/2008 | Hwang et al. | |
| 2009/0236485 | A1 | 9/2009 | Goepfert | |

FOREIGN PATENT DOCUMENTS

| | | |
|---|---|---|
| GB | 2381366 | 4/2003 |
| NZ | 314083 | 6/1998 |
| WO | WO 98/19100 | 5/1998 |
| WO | 2006060399 | 6/2006 |
| WO | 2006102293 | 9/2006 |
| WO | WO 2006/102293 | 9/2006 |
| WO | 2008040314 | 4/2008 |

OTHER PUBLICATIONS

Budget X Banner Stand—You Tube http://www.youtube.com/watch?v=P5FWkq0xLx0&feature=related, Feb. 27, 2009.

Bmboo X Banner—You Tube http://www.youtube.com/watch?v=PQBulcjReJM&feature=related, Mar. 1, 2009.

* cited by examiner

2002b

2006
Z
2001
2003b
2002b
2004 a
2004b
2003a
2002a
2002
2001
3a
2001
2002a

2005

SUPPORT SYSTEMS

TECHNICAL FIELD

The present invention relates to improvements in and relating to Support Systems. In particular the present invention relates to improvements relating to support systems for supporting a sheet of material. Even more particularly the present invention relates to a banner support system.

BACKGROUND ART

The present invention has a broad variety of applications for supporting sheet material. For ease of reference however the present invention will now be described in relation to banner support systems.

At present a number of different systems exist for supporting banners.

However most systems utilise a heavy aluminium base which has a retraction system for rolling up the banner for storage and transport purposes and a pole for holding the banner erect when in use.

These systems are expensive to transport because of their weight and can be cumbersome to carry for long periods.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

It is an object of the present invention to address the foregoing problems or at least to provide the public with a useful choice.

Further aspects and advantages of the present invention will become apparent from the ensuing description which is given by way of example only.

DISCLOSURE OF THE INVENTION

According to one aspect of the present invention there is provided a support locator which includes at least one body portion and at least one support portion, wherein the support portion is adapted to be capable, in use, of engaging and retaining at least one strut member, and wherein the body portion is adapted to be connectable to a sheet of material.

A support locator substantially as described above wherein the support portion projects out from a substantially planar body portion.

According to one aspect of the present invention there is provided a support locator which includes at least one body portion and at least one support portion, wherein the body portion has a connector surface, which in use, is the foundation for attaching the support locator, to at least one sheet of material, and wherein the support portion is configured to receive, at least one strut, in a direction which is substantially parallel, to the plane of the connector surface.

It is envisaged that the body portion can have a variety of different forms without departing from the scope of the present invention.

In preferred embodiments the body portion may be substantially planar in nature, or have at least one planar outer surface (connector surface) which is used for attachment to a sheet of material.

In other embodiments the body portion may include two substantially planar body portions on either side of the support portion. Preferably, there may be two connector surfaces on either side of the support portion.

In other embodiments the body portion may be shaped to surround the support portion.

In still further embodiments the body portion may be in the form of a cube, box, pyramidal or other shaped configuration.

In all preferred embodiments the base of the body portion or a part thereof may be adapted to be connectable to the sheet of material.

In some preferred embodiments the base of the body portion may be adapted to be releasably connectable to the sheet material. For example, the base of the body portion may include, but should not be limited to:

clips;

a fabric of hooks; or a fabric of loops.

In other embodiments the body portion may include a self-adhesive layer.

In some further embodiments the body portion may be attached to the sheet of material by self-adhesive tape.

In some other embodiments the body portion may include apertures which can facilitate sewing or riveting the body portion to the sheet of material. In some embodiments the apertures may be used for attaching support portions in the forms of clips to the body portion.

The support portion may generally include, or be in the form of, an aperture which receives the strut.

However, in some embodiments the support portion may be in the form of a protrusion which engages an aperture in the support strut. For example only the support portion may be in the form of a protrusion which is constructed to releasably expand and engage into an aperture on the strut.

Alternatively, in some even further embodiments the support portion may be in the form of a clip which receives the strut. For example the clip may be a in a non-limiting example a substantially C shaped resilient member which has a mouth smaller than the sides of the C.

In preferred embodiments the support portion may be in the form of a semi-conical shaped aperture, which is positioned relative to the sheet of material in use, so as to be tapered away from, the entry point of the strut.

The support portion may be adapted to project out from the body portion in a number of different ways.

In preferred embodiments the support portion may be at least one surface which projects out from the top surface of the body portion. For example the surface may be angled at 45 degrees to the top surface.

In other preferred embodiments the support portion may be at least one surface which projects substantially orthogonally out of the top surface of the body portion. In some embodiments, the support portion may be folded out from the body portion. In such embodiments, preferably, the predefined fold line is shaped to produce an aperture.

In other embodiments the support portion may be cast or otherwise inherently formed so as to project substantially out from the body portion.

Strut Member

The strut member may come in a variety of different forms.

In general the strut member may be a hollow at least semi rigid elongate member which is made of a lightweight material.

In preferred embodiments the strut may be tubular in nature.

In some embodiments the strut may be made of a plastic tube.

In preferred embodiments the strut may be an aluminium tube.

In some further preferred embodiments the strut may be made to have one or more sections which are adapted to be telescopically adjustable. In some preferred embodiments the sections may be two or more sub-struts which fit inside a larger sub-strut member and the smaller sub-struts may be held in position relative to the larger strut member by a hose clip or such like. The hose clip preventing the smaller sub-struts from sliding further into the larger sub-strut.

In preferred embodiments the strut at a region or point proximate the distal ends thereof may include a stop. In general, the stop may be a projection, lip or other radial protrusion which effectively holds the support locator in a set position with respect to the strut to hold the banner in taught manner. As the stop prevents the locator sliding further along the strut towards the proximate end thereof.

It should be appreciated that other arrangements to hold the locator and strut in a fixed position may also be employed without departing from the scope of the present invention.

Sheet of Material

A sheet of material which includes support locators along at least the four corners of the sheet of material.

The sheet of material may be any sheet of material on which one wants to display a pattern, message, picture or other printed matter.

In preferred embodiments the sheet of material may be vinyl or such like. However, this should not be seen in any way as being limiting.

In some embodiments the sheet of material may be paper. In some further embodiments the sheet of material may be composed of several sheets of material which have been joined together. For example, the sheet of material may in one embodiment be made of two or more sheets of material taped together to form the message/image of the banner.

The sheet of material in some preferred embodiments may have been adapted to facilitate releasable connection of the support locators thereto. For example in embodiments where the support locator has a fabric of loops the sheet of material may have attached thereto a fabric of hooks (or vice versa) which can effect a releasable connection there between.

Connector Device

According to one aspect of the present invention there is provided a connector device which includes at least one pair of axially opposed receiving portions wherein each receiving portion is configured to receive one end of a strut member and wherein the receiving portions include a retaining device which is coupled to at least the strut member associated with the receiving portion. A connector which includes two pair of receiving portions wherein the major axis of each pair of receiving portions intersect one another so as to substantially form a cross.

The connector device may be generally be in the form of a sleeve, or pair of axially opposed apertures in a body, which can receive and retain, in use, the ends of a strut member(s).

The retaining device may come in a variety of different forms without departing from the scope of the present invention.

In preferred embodiments the retaining device may be in the form of a flexible elastic length of material. Most preferably the retaining device may be in the form of a bungee cord.

In all embodiments the retaining device is attached to the connector device at one end and to the strut member at the other.

Self Supporting Banner Assembly

A self supporting banner assembly which includes:

at least one sheet of material which will form the banner;

at least four support locators;

at least two strut members;

wherein in use the support locators will be attached to the four corners of the sheet material and used to locate and retain the strut members.

A self supporting banner assembly substantially as described above which also includes a connector device.

The connector device enables the effective length of the strut members to be reduced which facilitates storage and transportation by effectively halving the length of the strut member that is required to diagonally span between diagonally opposed support locators.

A self supporting banner assembly which further includes one or more feet connected or connectable to the lower ends of the strut members.

In some embodiments the feet may connect directly to the ends of the strut protruding through the support locators.

In preferred embodiments the feet may be connected to the ends of the strut member by a T-connector.

The feet may be one or more struts.

Preferably the feet may be hollow in nature and have the same or similar attributes to the strut members.

In some further preferred embodiments the feet may include caps on each end thereof.

Thus, at least preferred embodiments of the present invention can include one or more of the following advantages over the prior art:

providing a cheap lightweight alternative to existing banner systems;

providing a more easily transportable banner system;

providing a banner that can be easily sent to a remote destination sans an accompanying person. Allowing for a self supporting banner to be sent to a remote event ahead of time and not carried as part of the baggage of an attendee.

BEST MODES FOR CARRYING OUT THE INVENTION

Figure 1:
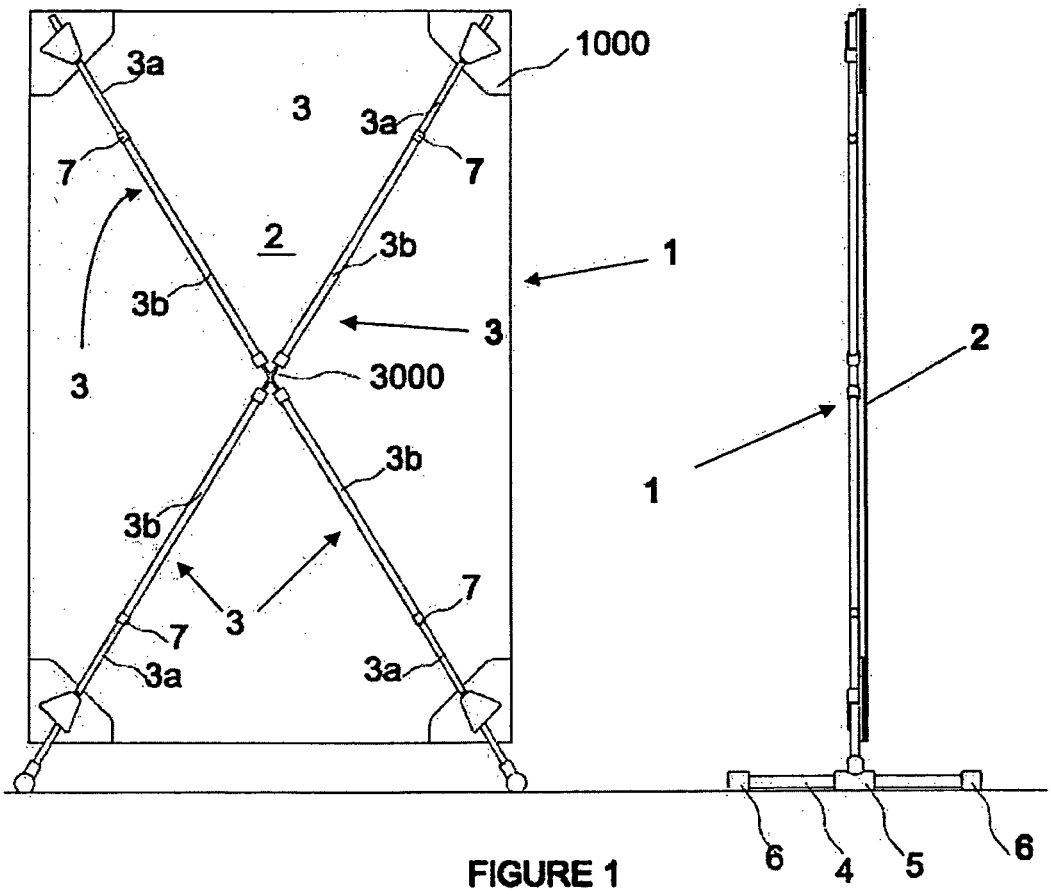
FIG. 1 shows a perspective view of a banner support assembly which is supporting a banner according to one preferred embodiment of the present invention.
Figure 2:
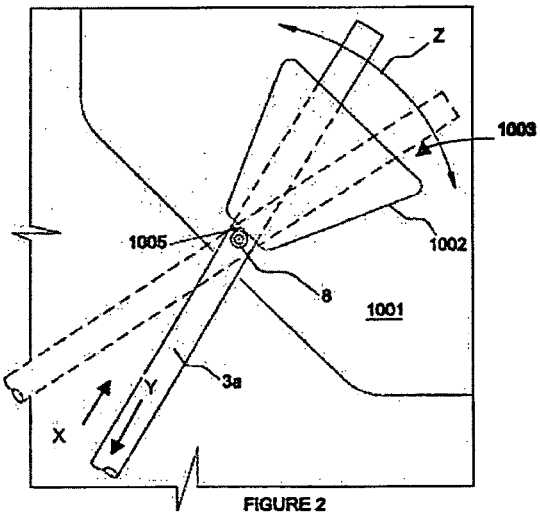
FIG. 2 shows a plan view of a support locator in accordance with one preferred embodiment of the present invention.
Figure 3:
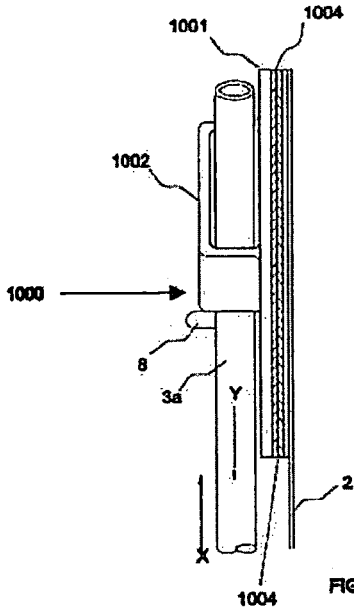
FIG. 3 shows a side view of the support locator shown FIG. 2.

With respect to FIGS. 1-3 there is provided a banner support assembly (BSA) generally indicated by arrow 1. The BSA has a sheet of material forming the banner 2 which is held upright and in a flat plane (i.e. taught) via support locators 1000 strut members 3 and feet 4. The feet 4 are connected to the distal ends of the struts 3 via T-connectors 5. The feet 4 have end caps 6 on the distal ends thereof.

The struts members 3 have a telescopic section 3*a* which slides out from a proximate section 3*b*. The telescopic section 3*a* is dimensioned to slide within proximate section The distal end of proximate section 3*b* has a slit (not shown) in the end thereof which allows a hose clip 7 when tightened to hold the telescopic section 3*a* in place once it has been extended the required distance. Conversely loosening the hose clip 7 allows the bold allows for the telescopic section 3*a* to be further extended or retracted.

The struts 3 are attached to the banner 2 via support locators 1000 and diagonally opposed struts are joined by a connector 3000.

With respect to FIGS. 2 and 3 there is shown a support locator 1000 in greater detail. The support locator 1000 has a body portion 1001 which is planar in nature and a support portion 1002. The support portion 1002 is semi-conical shaped projection which creates a tapered aperture 1003 through which the distal end of the telescopic section 3*a* can pass. The body portion 1001 is connected to the banner 2 via an adhesive strip 1004. The telescopic portion 3*a* of the strut 3 has a stop in the form of a pin 8 which abuts against edge 1005 of support portion 1002. The stop 8 holds the support locator in a set position with respect to the strut 3 to hold the banner in taught manner. As the stops inhibits relative movement with respect to the strut 3*a* and the support locator 1000 in the direction of arrow Y towards the proximate end of the strut 3. This allows the struts 3 to exert a force in the direction of arrow X towards the support locators 1000 on each corner of the banner 2 to hold the banner taught. The semi-conical shaped projection 1002 allows for the angle of the strut 3 relative to the support locator 1000 to vary as shown be double headed arrow Z depending on the width/height of the banner.

Figures 4, 5, 6:
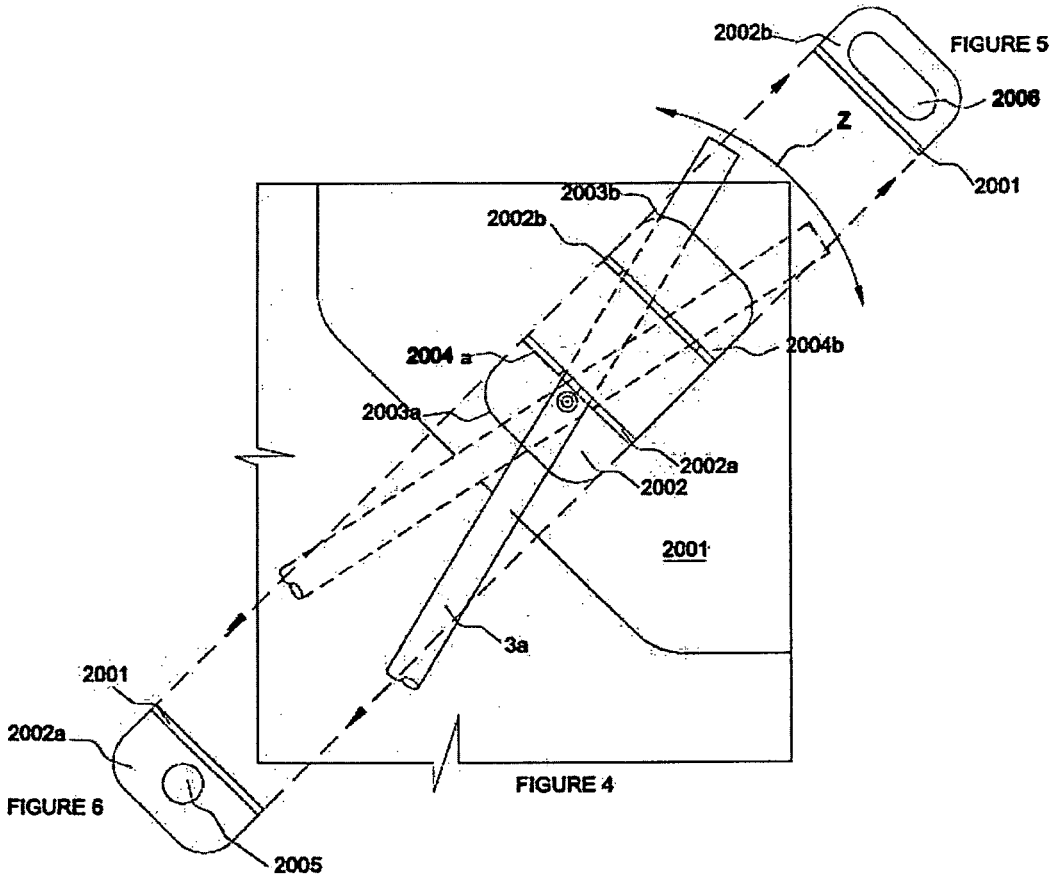
FIG. 4 shows a plan view of a support locator in accordance with a further preferred embodiment of the present invention.
FIG. 5 shows an end on view of one of the support portions on the support locator in FIG. 4.
FIG. 6 shows an end on view of another of the support portions on the support locator in FIG. 4.

FIGS. 4-6 show an alternate support connector 2000 having a body portion 2001 and two support portions 2002*a* and 2002*b*. The support portions 2002*a* and 2002*b* are flaps which fold up from the top surface of the body portion 2001 after breaking along previously perforated lines 2003*a* and 2003*b*, and fold lines 2004*a* and 2004*b*. Support portion 2002*a* has a round hole 2005 and support portion 2002*b* has a horizontal slot 2006. The slot 2006 again allows for the angle of the strut 3 relative to the support locator 2000 to vary as shown by the dotted outline of strut 3 depending on the width/height of the banner.

Figure 8:
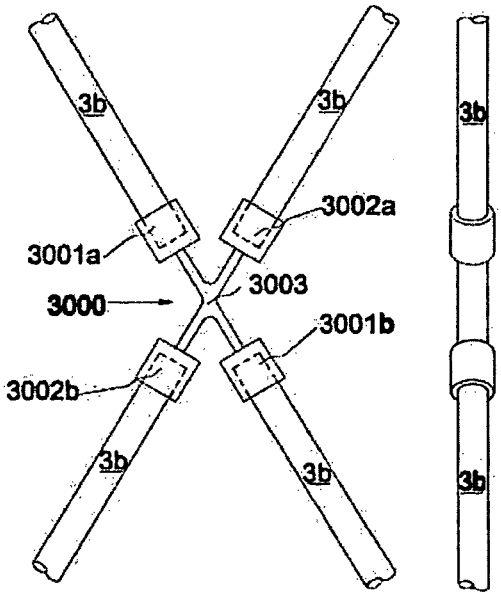
FIG. 8 Shows a connector in accordance with another preferred embodiment of the present invention.
Figure 7:
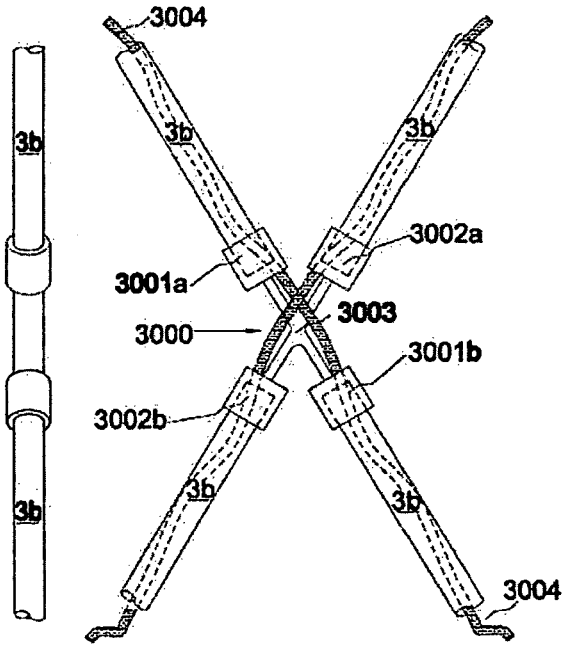
FIG. 7 shows a connector in accordance with one preferred embodiment of the present invention.

FIGS. 7 & 8 shows the connector 3000 in greater detail. The connector 3000 is made from a flexible plastic such as polypropylene and has two pairs of axially opposed receiving portions in the form of sleeves 3001*a, b* and 3002*a,b*. The sleeves 3001*a,b* and 3002*a,b* are connected to one another via a cross shaped body portion 3003. The arms of the cross shaped body portion 3003 are flexible which allows for the angle between adjacent struts to vary depending on the width/height of the banner. The sleeves each have a retaining device in the form of bungee cord 3004 which is connected at either end to diagonally opposed struts 3*a* and travels through the centre of struts 3*b*.

Figure 9:
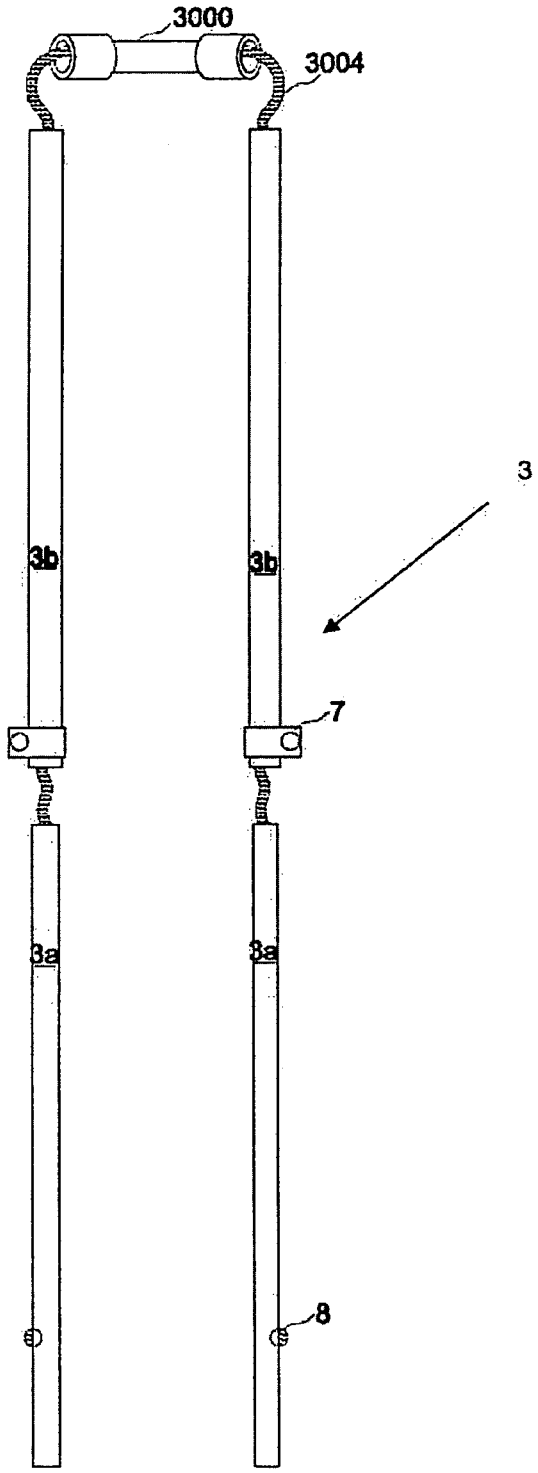
FIG. 9 Shows the struts and connector is a stowage configuration.
Figure 10:
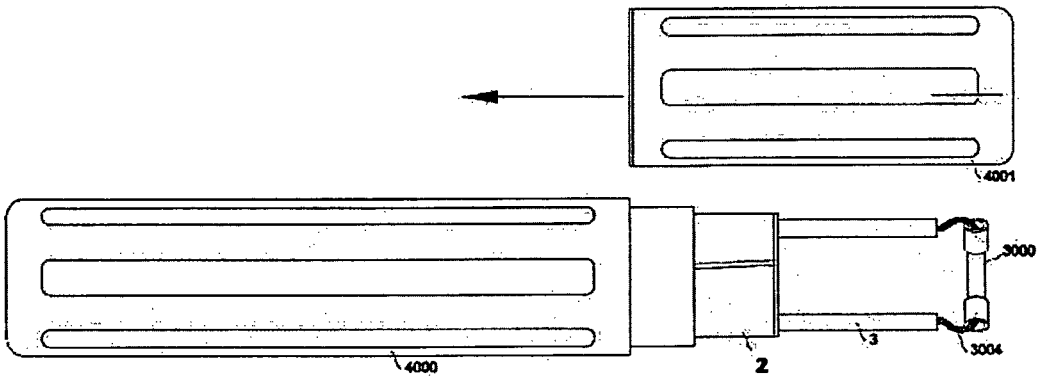
FIG. 10 Shows the banner and struts and connector being stowed in a tube for storage/transport.

FIGS. 9 and 10 show the connector 3000 bungee 3004 and struts 3 in a collapsed configuration. In FIG. 10 the connector 3000 bungee 3004 and struts 3 are placed within the banner 2 which has been rolled up for sliding into a storage tube 4000 which has a lid 4001.

Figure 11:
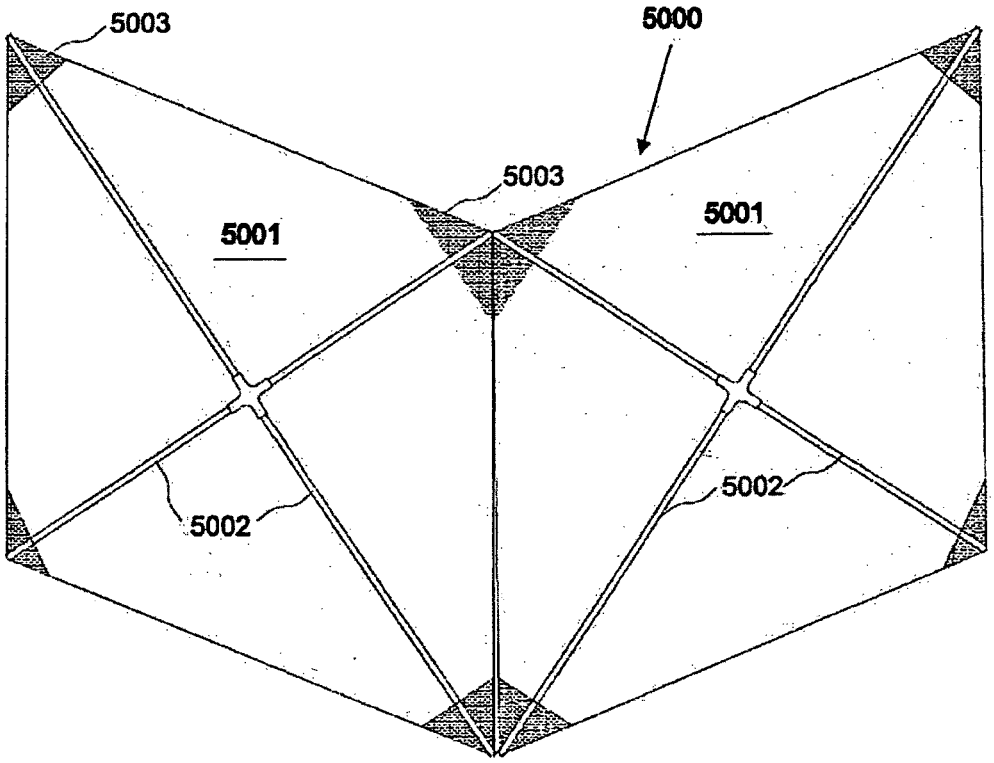
FIG. 11 Shows an alternate banner support assembly in accordance with another aspect of the present invention.

FIG. 11 shows an alternate banner support assembly as shown by arrow 5000. The banner 5001 is self standing and uses struts 5002 located in support locators 5003.

Figure 12:
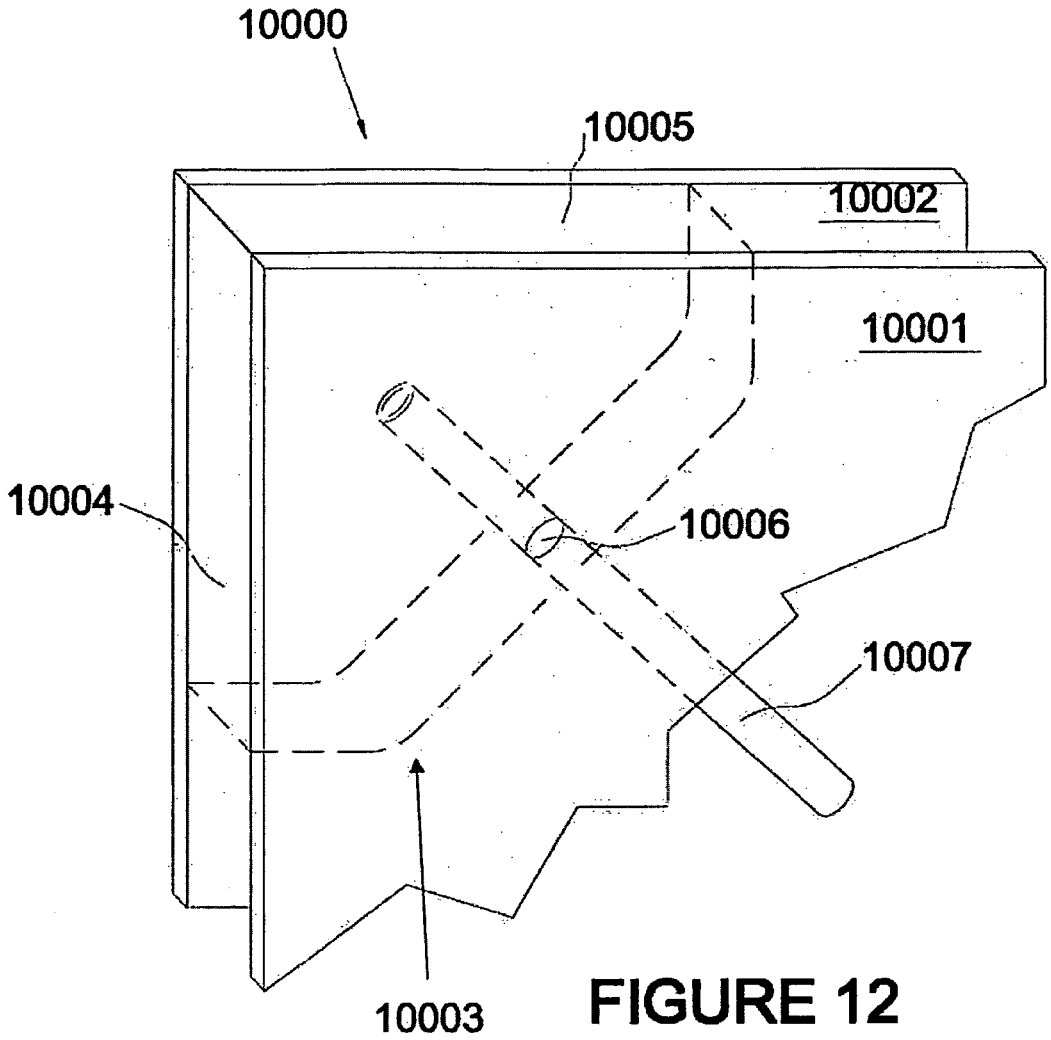
FIG. 12 Shows a partial view of one corner of a double sided banner using an alternate banner support assembly in accordance with yet another aspect of the present invention.

FIG. 12 shows an alternative preferred embodiment banner support assembly 10000 being used to support two sheets of material forming a first banner 10001 and second banner 10002 respectively. The banner support assembly has support locators 10003 attached to each of the four corners of the banners of which only one locator 10003 is shown positioned on the underside of: the top right hand corner of banner 10001 and left hand corner of banner 10002 respectively. The support locator has a body portion 10004 which has two connector surfaces 10005 of which only one can be seen which form the foundation for attaching the support locator to the banners 10001 and 10002 respectively. The connector surfaces have a fabric of loops in the form of a triangular VELCRO™ patch 10009 stuck thereto. This is hooked to a fabric of hooks in the from a triangular VELCRO™ patch 10010 which is attached to the underside of top right hand corner of the banner 10001. The body portion 10004 has a support portion in the form of an aperture 10006 which receives a strut member 10007.

Figure 13:
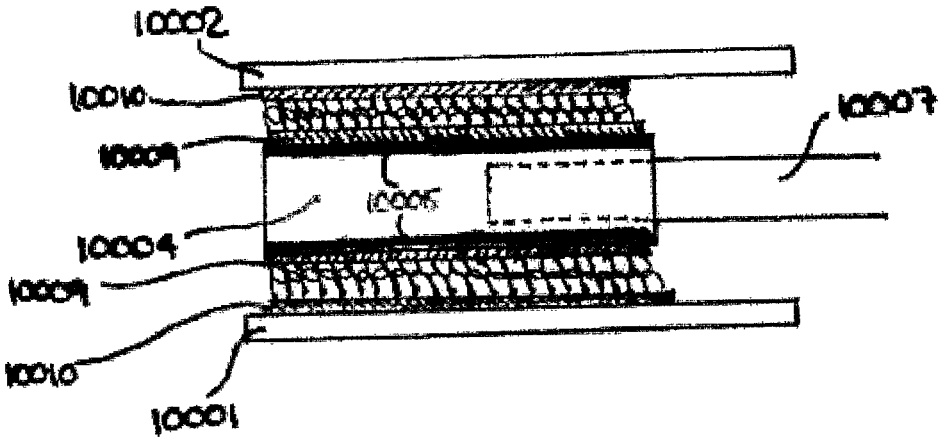
FIG. 13 Shows the support locator in FIG. 12 in more detail.

FIG. 13 shows the VELCRO™ loop patches 10009 which are stuck via and adhesive 10008 to the connector surfaces 10005. Connected to the VELCRO™ loop patches 10009 are VELCRO™ hook patches 10010 which are connected to respective banners 10001 and 10002 via adhesive 10011.

It will be appreciated the remainder of the banner support assembly depicted in FIGS. 12 and 13 that is not shown in these figures may be substantially similar to those shown and described in the previous figures.

Aspects of the present invention have been described by way of example only and it should be appreciated that modifications and additions may be made thereof without departing from the scope of the appended claims.

What we claim is:

1. A support locator, comprising at least one body portion and at least one support portion projecting from said at least one body portion, wherein said at least one support portion includes an aperture passing through said at least one support portion, said aperture configured for receiving and retaining under tension a terminal end of at least one strut member within said at least one support portion, and wherein the at least one body portion includes a connector surface adapted for attaching to a corner of a banner formed from a sheet of material on a non-printed side of the banner, wherein said at least one support portion is substantially orthogonal to a plane of said at least one body portion, said plane being parallel to both the sheet of material and a direction in which said at least one strut member enters said aperture.

2. The support locator as claimed in claim 1, wherein said at least one body portion has a connector surface which, in use, is a foundation for attaching the support locator, to the sheet of material, and wherein said at least one support portion is configured to receive said at least one strut member in a direction which is substantially parallel to the plane of the connector surface.

3. The support locator as claimed in claim 1, wherein there are two body portions in the form of connector surfaces on either side of the support portion.

4. A banner which includes support locators as claimed in claim 1.

5. A support locator, comprising at least one body portion and a support portion having a tapered aperture, said tapered aperture being configured for receiving and retaining under tension a terminal end of at least one strut member within said support portion, and enables the terminal end of said at least one strut member to pass therethrough and pivot relative to said at least one body portion, and wherein said at least one body portion includes a connector surface adapted for attaching to a corner of a banner formed from a sheet of material on a non-printed side of the banner, wherein the support portion is substantially orthogonal to a plane of said at least one body portion which itself is parallel to both that of the sheet of material and a direction in which said at least one strut member enters the aperture.

* * * * *